US009109556B2

(12) United States Patent
Adachi et al.

(10) Patent No.: US 9,109,556 B2
(45) Date of Patent: Aug. 18, 2015

(54) FUEL INJECTION DEVICE

(75) Inventors: Naofumi Adachi, Takahama (JP); Tsukasa Yamashita, Kariya (JP)

(73) Assignee: DENSO CORPORATION, Kariya (JP)

( * ) Notice: Subject to any disclaimer, the term of this patent is extended or adjusted under 35 U.S.C. 154(b) by 207 days.

(21) Appl. No.: 13/328,140

(22) Filed: Dec. 16, 2011

(65) Prior Publication Data

US 2012/0152206 A1 Jun. 21, 2012

(30) Foreign Application Priority Data

Dec. 17, 2010 (JP) ..... 2010-281996
Sep. 12, 2011 (JP) ..... 2011-198460

(51) Int. Cl.
*F02M 61/16* (2006.01)
*F02M 47/02* (2006.01)

(52) U.S. Cl.
CPC ..... *F02M 47/027* (2013.01); *F02M 61/168* (2013.01); *F02M 2200/8015* (2013.01); *F02M 2200/8061* (2013.01); *F02M 2547/001* (2013.01); *F02M 2547/008* (2013.01)

(58) Field of Classification Search
CPC ..... F16K 31/0644; F16K 31/0651; F16K 31/0655; F16K 31/0658; F16K 31/0662; F02M 61/168; Y10S 239/04
USPC ..... 239/533.2, 88, 57–59, 482–486, 600, 239/585.1, 585.5; 251/30.05, 30.02, 251/129.15; 123/447, 90.65, 275, 261, 445, 123/429, 431, 510, 511, 442, 467–470, 456
See application file for complete search history.

(56) References Cited

U.S. PATENT DOCUMENTS 3,450,353 A * 6/1969 Eckert ..... 239/585.2
4,317,542 A * 3/1982 Morishita et al. ..... 239/491
4,610,080 A * 9/1986 Hensley ..... 29/602.1
4,826,080 A 5/1989 Ganser
5,161,743 A * 11/1992 Takeda et al. ..... 239/533.11
5,328,100 A * 7/1994 Bergstrom et al. ..... 239/585.4

(Continued)

FOREIGN PATENT DOCUMENTS

DE 102008005652 A1 * 1/2009
EP 1 656 498 11/2008

(Continued)

OTHER PUBLICATIONS

Office Action (8 pages) dated May 23, 2013, issued in copending U.S. Appl. No. 13/343,126 of Yamashita, filed Jan. 4, 2012.

(Continued)

*Primary Examiner* — Hung Q Nguyen
*Assistant Examiner* — Josh Campbell
(74) *Attorney, Agent, or Firm* — Nixon & Vanderhye P.C.

(57) ABSTRACT

A fuel injection device includes a cylinder defining a pressure chamber at an end portion of a nozzle needle. In the cylinder, a floating plate is provided as a controlling member of fuel pressure. An orifice member and a nozzle body are lined by an annular positioning member, using a circular peripheral surface of the orifice member and a circular peripheral surface of the nozzle body as a reference surface. Thereby, radial locations of the nozzle body and the orifice member are defined. Furthermore, a location of the floating plate is defined by the nozzle body with the nozzle needle. Therefore, the floating plate can be located to a proper location relative to the orifice member.

15 Claims, 8 Drawing Sheets

(56) References Cited

U.S. PATENT DOCUMENTS

| | | | | |
|---|---|---|---|---|
| 5,487,368 | A * | 1/1996 | Bruning | 123/470 |
| 6,092,737 | A | 7/2000 | Bosch et al. | |
| 6,102,302 | A | 8/2000 | Nishimura | |
| 6,223,727 | B1 * | 5/2001 | Tahara et al. | 123/470 |
| 6,705,551 | B1 | 3/2004 | Kienzler et al. | |
| 6,805,103 | B1 * | 10/2004 | Sumida et al. | 123/470 |
| 6,892,955 | B2 * | 5/2005 | Grabandt | 239/88 |
| 7,621,469 | B2 * | 11/2009 | Hornby | 239/600 |
| 7,798,433 | B2 * | 9/2010 | Onishi et al. | 239/600 |
| 7,823,565 | B2 * | 11/2010 | Chern et al. | 123/470 |
| 2003/0052198 | A1 | 3/2003 | Tappolet et al. | |
| 2003/0079724 | A1 * | 5/2003 | He et al. | 123/467 |
| 2004/0069279 | A1 * | 4/2004 | Maier et al. | 123/467 |
| 2006/0157581 | A1 * | 7/2006 | Kiss et al. | 239/88 |
| 2006/0202145 | A1 * | 9/2006 | Ricco et al. | 251/129.16 |
| 2007/0221171 | A1 * | 9/2007 | Reiter | 123/445 |
| 2009/0065614 | A1 | 3/2009 | Ganser | |
| 2009/0261184 | A1 * | 10/2009 | Petrecchia et al. | 239/585.3 |
| 2009/0277423 | A1 * | 11/2009 | Cooke | 123/494 |
| 2011/0011373 | A1 * | 1/2011 | Shimura et al. | 123/497 |
| 2012/0175435 | A1 | 7/2012 | Yamashita | |

FOREIGN PATENT DOCUMENTS

| | | | | |
|---|---|---|---|---|
| EP | 1656498 | B1 * | 11/2008 | |
| JP | P2007-297962 | A | 11/2007 | |
| JP | WO2009122798 | * | 2/2009 | |
| JP | WO 2009/122798 | A1 * | 10/2009 | 123/497 |
| WO | WO 2005/019637 | | 3/2005 | |
| WO | WO 2009122798 | A1 * | 10/2009 | |

OTHER PUBLICATIONS

Office Action (2 pages) dated Jan. 8, 2013 issued in corresponding Japanese Application No. 2011-198460 and English translation (3 pages).

Office Action (7 pages) dated Jan. 3, 2014, issued in corresponding Chinese Application No. 201110434371.7 and English translation (5 pages).

* cited by examiner

FUEL INJECTION DEVICE

CROSS REFERENCE TO RELATED APPLICATION

This application is based on Japanese Patent Applications No. 2010-281996 filed on Dec. 17, 2010, and No. 2011-198460 filed on Sep. 12, 2011, the contents of which are incorporated herein by reference in its entirety.

TECHNICAL FIELD

The present invention relates to a fuel injection device, which controls fuel pressure applied to a valve member that allows or interrupts fuel injection from injection holes.

BACKGROUND ART

Patent documents 1 to 3 (EP 1656498B1, JP 06-108948A, JP 4054621B2 (corresponding to US 2003/0052198A1)) describe regarding fuel injection devices that have a pressure chamber and a pressure control mechanism. The pressure chamber applies fuel pressure to a valve member that allows or interrupts fuel injection from injection holes. The pressure control mechanism controls the inside pressure of the pressure chamber to move the valve member. In the fuel injection devices, it is proposed to use a pressure-response type control member as the pressure control mechanism, which moves in response to the change of pressure caused by the opening and closing of a solenoid valve. In this type of the fuel injection device, for achieving expected performance, each component of the fuel injection device needs to be positioned accurately at each proper location.

SUMMARY OF INVENTION

In view of the foregoing matters, it may be considered to use pins for arranging the components of the fuel injection device in proper positions. FIG. 7 is a cross-sectional view of a fuel injection device P10 that uses alignment pins as a comparative example of the present invention. A needle P1 is held in an inside of nozzle body P2 to open and close injection holes. The nozzle body P2 includes the injection holes. The nozzle body P2 is fixed to an orifice member P3 by a retaining nut P4. A cylinder P5 is provided in an inside of the nozzle body P2. An end portion of the needle P1 is inserted into the cylinder P5 as a piston. The cylinder P5 is pressed to the orifice member P3. A pressure chamber is defined in an inside of the cylinder P5. A floating plate P6 is provided in an inside of the pressure chamber as a control member. The floating plate P6 controls inflow of the fuel into and outflow of the fuel from the pressure chamber.

Pins P71, P72 are provided in a location between the nozzle body P2 and the orifice member P3. The pins P71, P72 make the nozzle body P2 and the orifice member P3 positioned at proper locations. Hole portions P81, P82 are arranged in the nozzle body P2. The hole portion P81 holds the pin P71, and the hole portion P82 holds the pin P72. Hole portions P91, P92 are arranged in the orifice member P3. The hole portion P91 receives the pin P71, and the hole portion P92 receives the pin P72.

However, alignment structure using the pins P71, P72 has factors that may cause errors. Dislocation between the nozzle body P2 and the orifice member P3 is caused by, for example, the positioning errors of the hole portions P81, P82, P91, P92, the size errors of the hole portion P81, P82, P91, P92, and the size errors of the pins P71, P72, and so on.

For example, the dislocation of the nozzle body P2 and the orifice member P3 deteriorates the location accuracy of the nozzle body P2. The above described dislocation may cause change in a state of communication between fuel passages. Therefore, the above described dislocation may cause the change of a characteristic of the fuel injection. In addition, the variations of the characteristic of the fuel injection may occur in each product. This kind of problem may occur in both the fuel injection device using the cylinder P5 and the fuel injection device not using the cylinder P5. Furthermore, this kind of the problem may occur in both the fuel injection device using a pressure-response type control member and the fuel injection device not using the pressure-response type control member.

In the fuel injection device using the cylinder P5, the dislocation of the nozzle body P2 and the orifice member P3 causes, for example, the radial dislocation of the orifice member P3 and the cylinder P5. Due to this kind of the dislocation, the desired performance of the fuel injection may not be achieved. In addition, the variations of the characteristic of the fuel injection may occur in each product.

The dislocation of the nozzle body P2 and the orifice member P3 may cause a significant influence on the fuel injection device including the floating plate P6. FIG. 8 is a partially enlarged cross-sectional view of the fuel injection device of the comparative example that has a gap between components. FIG. 9 is a plane view of the fuel injection device of the comparative example that has the gap between the components. When the dislocation of the nozzle body P2 and the orifice member P3 is caused, a center axis AXP3 of the orifice member P3 and a center axis AXP5 of the cylinder P5 are moved from their proper locations. At this time, as shown in FIG. 9, a contact section (CS) between the orifice member P3 and the floating plate P6 is biased in the radial direction thereof. In addition, the amount of the bias is not in uniform. Thereby, deviation is caused in the pressure applied to the floating plate P6. As a result, the floating plate P6 may not achieve a desired performance thereof. Specifically, a desired fuel injection characteristic may not be achieved. Furthermore, the motion of the floating plate P6 may become unstable, so that the fuel injection characteristic may not be stable. Moreover, the motions of the floating plate P6 may vary in each product to cause differences of the fuel injection characteristic between them.

In view of the foregoing and other matters, it is an object of the present invention to provide a fuel injection device in which the components are positioned accurately in the radial direction thereof.

Another object of the present invention is to provide a fuel injection device in which the components are positioned accurately in the radial direction thereof with a structure that has high productivity.

Another object of the present invention is to provide a fuel injection device that achieves a stable fuel injection characteristic.

Another object of the present invention is to provide a fuel injection device that achieves the stable fuel injection characteristic with a structure ensuring high productivity.

One of the specific objects of the present invention is to improve the fuel injection characteristic in a fuel injection device that includes a cylinder defining a pressure chamber.

Another one of the specific objects of the present invention is to improve the fuel injection characteristic of a fuel injection device that includes a cylinder in which a control member is arranged.

According to a first aspect of the present disclosure, a fuel injection device is provided with a valve body, a valve member, a housing member, a control member and an annular positioning member. The valve body has therein a passage for a high-pressure fuel, and is provided with injection holes that are arranged at a tip end of the valve body to inject the high-pressure fuel to an inside of a combustion chamber of an internal combustion engine. The valve member moves in an axial direction of the valve body therein to allow or interrupt a supply of the high-pressure fuel to the injection holes. The housing member is provided to face to an end of the valve body and to define a pressure chamber, which controls movement of the valve body by adjusting fuel pressure applied to the valve body, and forms control passages through which fuel flows for controlling the fuel pressure in the pressure chamber. The control member is provided in an inside of the pressure chamber and contacts and detaches from the housing member to at least allow or interrupt a communication between an inflow passage and the pressure chamber, in which a radial location of the control member is defined by the valve body. The annular positioning member is fixed to a circular peripheral surface of the valve body and fixed to a circular peripheral surface of the housing member to set locations of the valve body and the housing member in a radial direction thereof.

In this configuration, the valve body and the housing member are set accurately to proper locations in these radial direction by the annular positioning member. Thereby, instability of the fuel injection characteristic, which is caused by the dislocation of the valve body and the housing member, can be limited.

According to a second aspect of the present disclosure, at least one of the valve body and the housing member may have a stepped surface that sets the location of the positioning member in the axial direction. In this configuration, the positioning member is set accurately to the proper location in the axial direction.

According to a third aspect of the present disclosure, an axial length (GC) of the positioning member may be larger than an axial length (RL) of the circular peripheral surface that is adjacent to the stepped surface such that GC>RL. In this configuration, fixing the positioning member to the valve body or the housing member makes the positioning member project from the valve body or the housing member. Therefore, fixing the positioning member to the valve body or the housing member becomes easy to be performed.

According to a fourth aspect of the present disclosure, a return spring may be provided between the housing member and the valve member to urge the valve member to a valve-close direction. An axial length (RL) of the circular peripheral surface and an axial length (GC) of the positioning member may be set such that a length (GP) of the projection of the positioning member projecting in the axial direction from the circular peripheral surface is larger than a compression amount (SP) of the return spring (GP>SP). In this configuration, even if the length of the return spring is equal to a free length, the projecting portion of the positioning member can be fixed to the valve body or the housing member.

According to a fifth aspect of the present disclosure, a thickness (GW) of the positioning member may be less than or equal to a width (RW) of the stepped portion such that GW≤RW. In this configuration, the positioning member can be received within the area of the stepped portion in its radial direction.

According to a sixth aspect of the present disclosure, the positioning member may have a slope that guide at least one of valve body and the housing member to a fixing portion. In this configuration, the slope guides at least one of the valve body and the housing member to its fixing portion. Thereby, inserting at least one of the valve body and the housing member into the inside of the positioning member becomes easy to be performed.

According to a seventh aspect of the present disclosure, the positioning member may be fixed to an outer circular peripheral surface of the valve body and fixed to an outer circular peripheral surface of the housing member to cover the valve body and the housing member. A fixing member may be provided radially outside of the positioning member to fix the valve body and the housing member in the axial direction. Furthermore, the positioning member may be held in the axial direction by the fixing member. In this configuration, the positioning member can be held in its axial direction by the fixing member, such as a retaining nut, which fixes the valve body and the housing member in the axial direction.

According to an eighth aspect of the present disclosure, the fuel injection device may further include a cylinder that holds a piston portion arranged at an end portion of the valve body, and may be located to urge the housing member and to define the pressure chamber together with the housing member. Furthermore, a radial location of the cylinder may be set by the valve member, and a radial location of the valve member may be set by the valve body. In this configuration, the radial location of the cylinder that urged the housing member can be set by the location of the nozzle body with the valve member. The valve body and the housing member are set accurately to proper locations respectively by the positioning member, and thereby the cylinder is also set accurately relative to the housing member.

According to a ninth aspect of the present disclosure, the control passage may include an inflow passage, which introduces fuel to the pressure chamber, and an outflow passage, which discharges the fuel out of the pressure chamber. Furthermore, a control member may be provided in an inside of the pressure chamber and contacts and detaches from the housing member to at least allow or interrupt a communication between the inflow passage and the outflow passage. A radial location of the control member may be defined by the valve body, and a radial direction of the control member may be defined by the cylinder. The housing member and the control member may configure a flat sealing surface that allows or interrupts a communication between the inflow passage and the pressure member. In this configuration, the radial location of the control member can be defined by the nozzle body with the cylinder and the valve member. That is, the control member and the housing member can be set accurately to proper locations, respectively. The flat sealing surface is provided between the housing member and the control member to allow the dislocation of the control member in the radial direction thereof. Even in this structure, the control member can be set to the proper location. Therefore, it can prevent the sealing surface of the flat sealing from being biased relative to the housing member. Thereby, the instability of the fuel injection characteristic, which is caused by the dislocation of the housing member and the control member, can be limited.

According to a tenth aspect of the present disclosure, the control passage may include a common supply passage that is commonly used for introducing fuel into and discharging the fuel out of the pressure chamber. In this configuration, the valve body and the housing member can be set to proper radial locations even in the fuel injection device including the common passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE INVENTION

Figure 1:
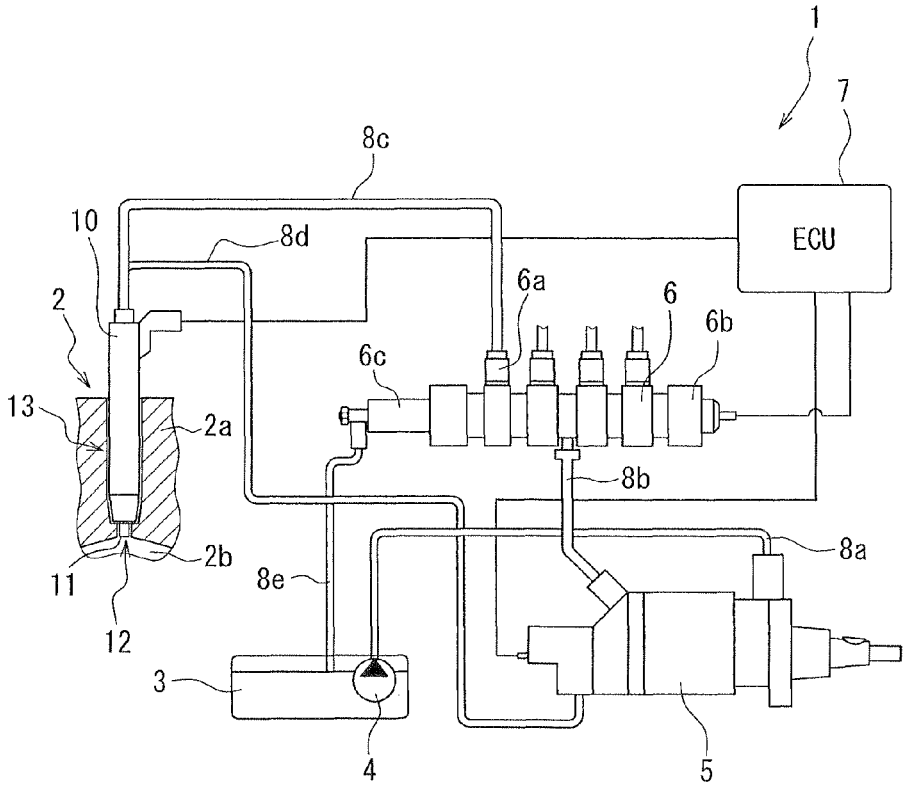
FIG. 1 is a block diagram of a fuel supply system according to a first embodiment in the present invention.

Various embodiments of the present invention will be described with reference to the accompanying drawings. In the following embodiments, similar components are indicated by the same reference numerals and will not be redundantly described to simplify the description. In each of the following embodiments, if only a part of a structure is described, the remaining part of the structure is the same as that of the previously described embodiment(s). Any one or more components of any one of the following embodiments may be combined with the components of the other one of the following embodiments without departing a scope and spirit of the present invention.

First Embodiment

FIG. 1 is a block diagram of a fuel supply system 1 according to a first embodiment in the present invention. A fuel injection device 10 of the first embodiment is used in the fuel supply system 1. The fuel supply system 1 supplies fuel to an internal combustion engine 2. The combustion engine 2 is a multi-cylinder diesel engine. A head member 2*a* of the combustion engine 2 defines a combustion chamber 2*b*. The fuel supply system 1 is a direct injection fuel supply system. The fuel injection device 10 injects fuel directly to an inside of the combustion chamber 2*b*. The fuel supply system 1 includes a fuel tank 3, a feed pump 4, a high-pressure fuel pump 5, a common rail 6, an electric control unit (ECU) 7, and the fuel injection device 10.

The feed pump 4 is an electrically driven pump. The feed pump 4 is housed in the fuel tank 3. The feed pump 4 is connected to the high-pressure fuel pump 5 through a fuel pipe 8*a*. The feed pump 4 applies a predetermined feed pressure to the liquid-state fuel in the fuel tank 3 to be supplied to an inside of the high-pressure fuel pump 5. An adjusting valve is arranged in the fuel pipe 8*a* to control the fuel pressure to a predetermined value.

The high-pressure fuel pump 5 is installed to the combustion engine 2. The high-pressure fuel pump 5 is driven by drive force generated by an output shaft of the combustion engine 2. The high-pressure fuel pump 5 is connected to the common rail 6 through a fuel pipe 8*b*. The high-pressure fuel pump 5 applies pressure to the fuel, which is supplied by the feed pump 4, to supply the fuel to the common rail 6. The high-pressure fuel pump 5 has a solenoid valve that is electrically connected to the ECU 7. The opening and closing of the solenoid valve are controlled by the ECU 7. The ECU 7 controls the solenoid valve to adjust the pressure of the fuel, which is supplied from the high-pressure fuel pump 5 to the common rail 6, to a predetermined value.

The common rail 6 is a pipe-shaped member made of a metal material such as chromium molybdenum steel. The common rail 6 has a plurality of branch components 6*a*. The number of the branch components 6*a* corresponds to the number of cylinders per bank of the combustion engine. Each of the branch components 6*a* is connected to the fuel injection device 10 through a fuel pipe forming a supply channel 8*c*. The fuel supply system 1 has a plurality of the fuel injection devices 10. The fuel injection device 10 and the high-pressure fuel pump 5 are connected to each other through a fuel pipe forming a return channel 8*d*. The common rail 6 temporarily stores high-pressure fuel supplied from the high-pressure fuel pump 5 therein. The common rail 6 distributes the high-pressure fuel to the fuel injection devices 10 through the supply channels 8*c*. The common rail 6 is equipped with a common rail sensor 6*b* at the one of the two end portions of the common rail 6 in an axial direction thereof. The common rail 6 is equipped with a pressure regulator 6*c* at the other end portion of the common rail 6. The common rail sensor 6*b* is electrically connected to the ECU 7 to detect the pressure and temperature of the high-pressure fuel and output signals to the ECU 7. The pressure regulator 6*c* maintains the pressure of the high-pressure fuel at a constant value, and decompresses excess fuel to discharge it out of the common rail 6. The excess fuel passing through the pressure regulator 6*c* is returned to the fuel tank 3 through a channel of a fuel pipe 8*e*, which causes the common rail 6 to communicate with the fuel tank 3.

The fuel injection device 10 is a fuel injection valve that directly injects high-pressure fuel from injection holes 11 to the combustion chamber 2*b*. The fuel injection device 10 has a valve mechanism that controls the injection of the high-pressure fuel from the nozzle holes 11 based on control signals from the ECU 7. The valve mechanism includes a main valve 12, which allows or interrupts the injection of the high-pressure fuel, and a control valve 13. For driving and controlling the valve mechanism, the fuel injection device 10 uses a portion of the high-pressure fuel supplied form the supply channel 8*c*. The fuel used for driving and controlling the valve mechanism is discharged into the return channel 8*d*, which causes the fuel injection device 10 to communicate with the high-pressure fuel pump 5, and then it returns to the high-pressure fuel pump 5. The fuel injection device 10 is inserted and fitted into an insertion hole arranged in the head member 2*a* of the combustion engine 2. The fuel injection device 10 injects the high-pressure fuel with an injection pressure of a range from 160 to 220 mega Pascal (MPa).

The ECU 7 is constructed of a microcomputer or the like. The ECU 7 is electrically connected to a plurality of sensors. The sensors electrically connected to the ECU 7 can include the common rail sensor 6*b* described above, a rotational speed sensor for detecting the rotational speed of the combustion engine 2, a throttle sensor for detecting a throttle opening, an air flow sensor for detecting the volume of intake air, a boost pressure sensor for detecting a boost pressure, a water temperature sensor for detecting a cooling water temperature, and an oil temperature sensor for detecting the oil temperature of lubricating oil. The ECU 7 outputs electric signals, for controlling the opening and closing of the solenoid valve of the high-pressure fuel pump 5 and the valve mechanism of each fuel injection device 10 based on the signals from the sensors, to the solenoid valve of the high-pressure fuel pump 5 and to each fuel injection device 10.

Figure 2:
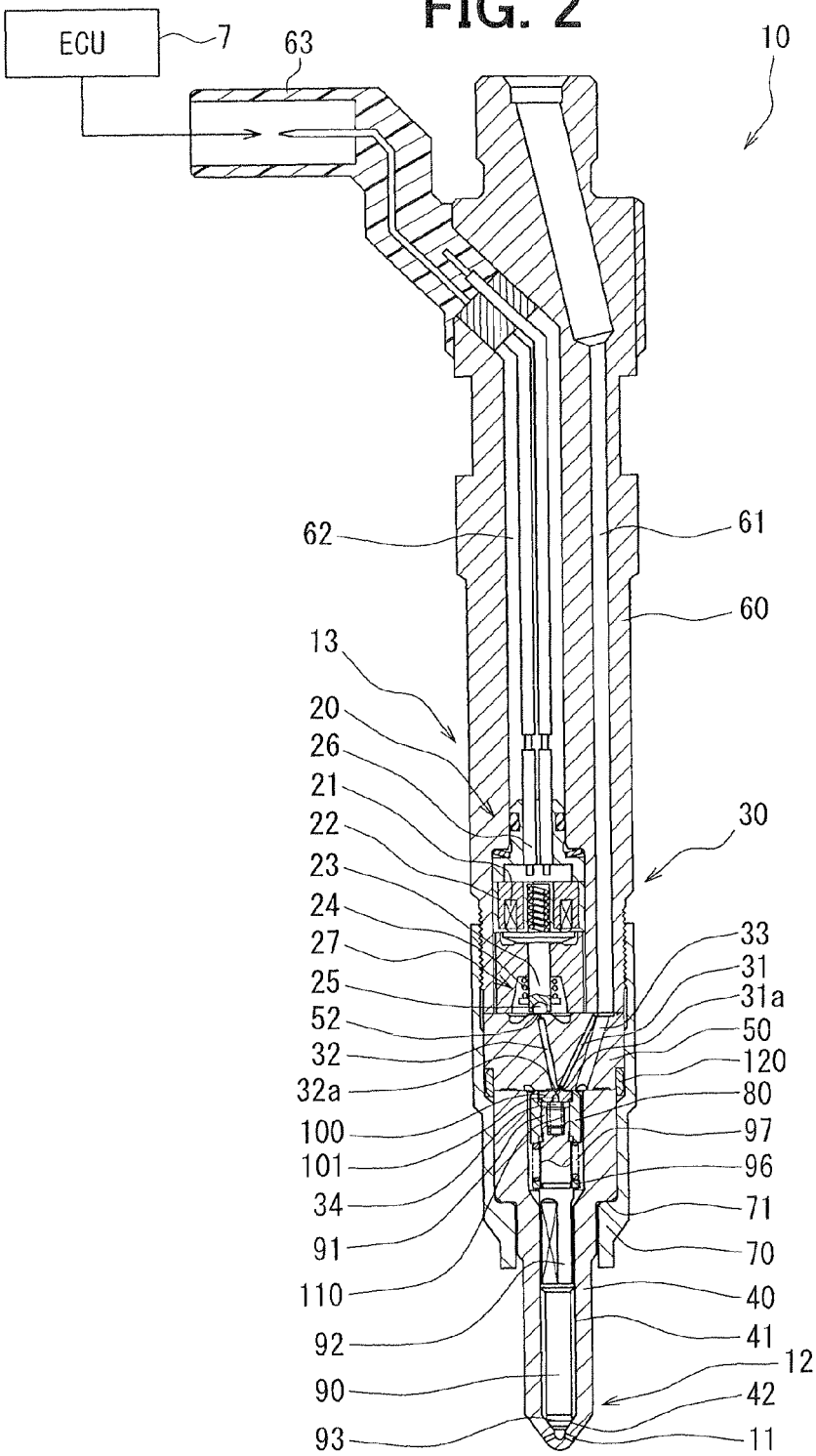
FIG. 2 is a cross-sectional view of a fuel injection device of the first embodiment.
Figure 3:
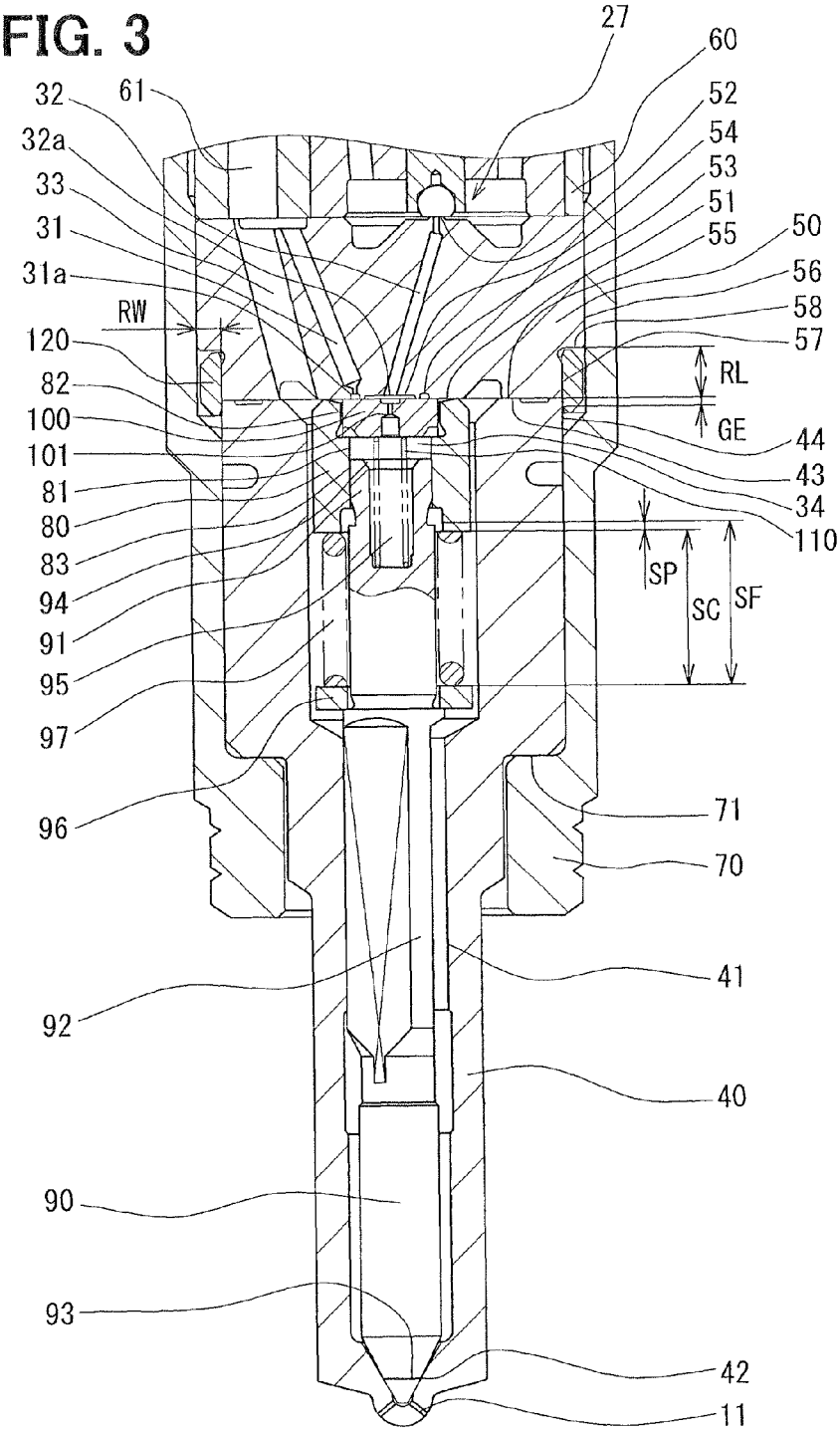
FIG. 3 is an enlarged cross-sectional view of the fuel injection device of the first embodiment.

FIG. 2 is a cross-sectional view of the fuel injection device 10 of the first embodiment. FIG. 3 is an enlarged view of the fuel injection device 10 of the first embodiment. In FIGS. 2 and 3, the cross sections of different components are shown respectively for clarifying the locations of the passages. The fuel injection device 10 includes a driving part 20, a control body 30, a nozzle needle 90 and a floating plate 100.

In FIG. 2, the driving part 20 is housed in the control body 30. The driving part 20 is a pilot-operated type solenoid valve. The driving part 20 constitutes the control valve 13. The driving part 20 includes a solenoid 21, a fixed member 22, a movable member 23, a spring 24, a valve seat member 25, and a terminal 26. The terminal 26 is a current-carrying member. One end part of the terminal 26 is exposed to an outside of the control body 30. The other end part of the terminal 26 is connected to the solenoid 21. The solenoid 21 is supplied with a pulse current from the ECU 7 through the terminal 26. When the solenoid 21 is supplied with the pulse current, it generates a magnetic field circling along the axial direction thereof. The fixed member 22 is a cylindrical member made of a magnetic material. The fixed member 22 is magnetized in the magnetic field generated by the solenoid 21. The movable member 23 has cylindrical shape having two steps and is made of a magnetic material. The movable member 23 is arranged at a tip side in an axial direction of the fixed member 22. The movable member 23 is attracted toward the fixed member 22 when the solenoid 21 is magnetized. The spring 24 is a coil spring. The spring 24 urges the movable member 23 in a direction separating from the fixed member 22. The valve seat member 25 forms a pressure control valve 27 together with a control valve seat portion 52 of the control body 30. The valve seat member 25 is arranged at an end portion of the movable member 23 in an axial direction thereof. The valve seat member 25 is seated on the control valve seat portion 52 to limit the flow of the fuel. When the magnetic field of the solenoid 21 is not generated, the valve seat member 25 is seated on the control valve seat portion 52 by the biasing force of the spring 24. When the magnetic field of the solenoid 21 is generated, the valve seat member 25 is separated from the control valve seat portion 52.

The control body 30 has a nozzle body 40, an orifice member 50, a holder 60, a retaining nut 70, and a cylinder 80. The nozzle body 40, the orifice member 50 and the holder 60 are arranged in this order from a tip side having the injection holes 11. The control body 30 defines an inflow passage 31, an outflow passage 32, a main supply passage 33, and a pressure chamber 34. A bottom surface of the orifice member 50 of the control body 30 provides an abutting surface 51, which is exposed to the pressure chamber 34. One end of the inflow passage 31 communicates with the supply channel 8*c*. The other end of the inflow passage 31 communicates with an inflow port 31*a* that is opened to the abutting surface 51. One end of the outflow passage 32 communicates with the return channel 8*d* through the pressure control valve 27. The other end of the outflow passage 32 communicates with an outflow port 32*a* opened to the abutting surface 51. The pressure chamber 34 is defined by the cylinder 80, the orifice member 50 and the nozzle needle 90. The high-pressure fuel passing through the supply channel 8*c* can flow into the pressure chamber 34 from the inflow port 31*a*. The fuel in the pressure chamber 34 can flow into the return channel 8*d* through the outflow port 32*a*. Control passages are provided by the inflow passage 31 and the outflow passage 32. The fuel flows inside the control passages for controlling the fuel pressure in the pressure chamber 34.

The nozzle body 40 is made of a metal material such as chromium molybdenum steel and has a cylindrical shape having a bottom portion. The nozzle body 40 has a nozzle needle housing portion 41, a valve seat portion 42, and the nozzle holes 11. The nozzle needle housing portion 41 is formed along an axial direction of the nozzle body 40 to be configured to a cylindrical hole shape and to hold the nozzle needle 90. High-pressure fuel is supplied into the nozzle needle housing portion 41. The valve seat portion 42 is arranged on a bottom wall of the nozzle needle housing portion 41. The valve seat portion 42 is configured to contact the tip end of the nozzle needle 90. The valve seat portion 42 is adapted as a fixed-side valve seat of the valve that allows or interrupts the flow of the high-pressure fuel. The injection holes 11 are located on a downstream side of the valve seat portion 42 in the fuel flow direction. A plurality of the nozzle holes 11 are formed to radially extend from the inside of the nozzle body 41 to the outside thereof. When the high-pressure fuel passes through the injection holes 11, the high-pressure fuel is atomized to be diffused. Thereby the fuel may be easily mixed with air. The nozzle body 40 is also referred to as a nozzle member or a valve body. The nozzle body 40 defines a high-pressure fuel passage therein. The injection holes 11 injecting the high-pressure fuel into the combustion chamber of the engine are arranged at a tip end of the nozzle body 40.

The cylinder 80 is formed in the shape of a circular cylinder made of a metal material. The cylinder 80 defines the pressure chamber 34 together with the orifice member 50 and the nozzle needle 90. The cylinder 80 is arranged in the nozzle needle housing portion 41 and located coaxially with the nozzle needle housing portion 43. An end surface of the cylinder 80 is located on a side of the orifice member 50 in the axial direction thereof. The end surface of the cylinder 80 is pressed to the abutting surface 51 of the orifice member 50. As a result, the cylinder 80 is fixed to the orifice member 50 to be held by the orifice member 50. The cylinder 80 can be moved relative to the orifice member 50. However, the cylinder 80 defines the pressure chamber 34 together with the orifice member 50, so that the cylinder 80 can be considered to belong to the orifice member 50. On the other hand, the location of the cylinder 80 in a radial direction thereof is defined by the nozzle body 40 together with the nozzle needle 90. Therefore, the cylinder 80 can also be considered to belong to the nozzle body 40.

In FIG. 3, the orifice member 50 is made of a metal material such as chromium molybdenum steel and has a cylindrical shape. The orifice member 50 is arranged to be held between the nozzle body 40 and the holder 60. The orifice member 50 forms the abutting surface 51, the control valve seat portion 52, the inflow passage 31, the outflow passage 32, and the main supply passage 33. The abutting surface 51 is formed in the orifice member 50 at the side of the nozzle body 40 in a central portion in the radial direction thereof. The abutting surface 51 is surrounded by the cylinder 80 to be configured in a circular shape. The control valve seat portion 52 is arranged at one of two end surfaces of the orifice member 50, which is a side of the holder 60 in an axial direction of the orifice member 50. The control valve seat portion 52 configures the pressure control valve 27 together with the valve seat member 25. The inflow passage 31 is inclined with respect to the center axial direction of the orifice member 50. The outflow passage 32 is extended toward the control valve seat portion 52 from the central portion of the abutting surface 51 in the radial direction thereof. The outflow passage 32 is inclined with respect to the center axial direction of the orifice member 50. The main supply passage 33 causes the supply channel 8*c* to communicate with the nozzle needle housing portion 41.

The orifice member 50 forms an inflow recess portion 53, an outflow recess portion 54, and the double annular abutting surface 51 on a surface that is opposed to the floating plate 100. The inflow recess portion 53 is configured into an annular groove shape that is coaxial with a central axis AX50 of the orifice member 50. The inflow recess portion 53 is depressed from the axial end face of the abutting surface 51. The inflow port 31*a* is opened at the inflow recess portion 53. The outflow recess portion 54 is configured into an annular groove shape to be coaxial with a central axis AX50 of the orifice member 50. The outflow recess portion 54 is defined at the radially central portion of the orifice member 50. The outflow recess portion 54 is depressed from the tip end face of the abutting surface 51 to be in a circular shape. The inflow recess portion 53 is defined at a radially outer side of the outflow recess portion 54. An inner ring of the abutting surface 51 is located between the inflow recess portion 53 and the outflow recess portion 54. The inflow recess portion 53 and the outflow recess portion 54 are separated from each other by a flat sealing surface formed by the inner ring of the abutting surface 51. When the tip end face of the abutting surface 51 contacts the floating plate 100, the flat sealing surface of the inner ring completely separates the inflow recess portion 53 from the outflow recess portion 54. An outer ring of the abutting surface 51 is located at a radially outer side of the inflow recess portion 53. The inflow recess portion 53 and the nozzle needle housing portion 41 are separated from each other by a flat sealing surface provided by the outer ring of the abutting surface 51. When the tip end face of the abutting surface 51 contacts the floating plate 100, the flat sealing surface of the outer ring completely separates the inflow recess portion 53 from the nozzle needle housing portion 41.

A sealing surface 55 is arranged at an end surface of the orifice member 50 which is opposed to the nozzle body 40. The sealing surface 55 is located at radially outer side of the main supply passage 33. A sealing surface 43 is arranged at an end surface of the nozzle body 40 which is opposed to the orifice member 50. The sealing surface 43 is located at radially outer side of the nozzle needle housing portion 41. The sealing surfaces 43, 55 provide the sealing portion to seal the high-pressure fuel in a space between the nozzle body 40 and the orifice member 50.

The orifice member 50 is also referred to as a housing member or an orifice plate. The orifice member 50 is formed to face the end portion of the nozzle needle 90. The orifice member 50 defines the pressure chamber 34, which adjusts the fuel pressure applied to the nozzle needle 90 to control the movement of the nozzle needle 90. In addition, the orifice member 50 defines the inflow passage 31, which introduces high-pressure fuel into the pressure chamber 34, and the outflow passage 32, which discharges fuel out of the pressure chamber 34.

The holder 60 is made of a metal material such as chromium molybdenum steel and has a cylindrical shape having a bottom portion. The holder 60 includes longitudinal holes 61, 62 and a socket portion 63. The longitudinal holes 61, 62 are defined along the axial direction of the holder 60. The longitudinal hole 61 is a fuel channel that causes the supply channel 8*c* to communicate with the inflow passage 31. The driving part 20 is held at the side of the orifice member 50 in the longitudinal hole 62. The socket portion 63 is formed at the side that is opposite from the orifice member 50 in the longitudinal hole 62 to block the opening of the longitudinal hole 62. One end of the terminal 26 of the driving part 20 projects into an inside of the socket portion 63. The socket portion 63 is a connector that is possible to be fitted with a plug electrically connected to the ECU 7. When the socket portion 63 is connected to the plug, a pulse current is possible to be supplied to the driving part 20 from the ECU 7.

The retaining nut 70 is made of a metal material and has a cylindrical shape with two steps. The retaining nut 70 holds a portion of the nozzle body 40, the orifice member 50, and a portion of the holder 60. The retaining nut 70 is threaded onto the end portion of the holder 60 adjacent to the orifice member 50. The retaining nut 70 has a stepped portion 71 on the inner peripheral wall portion thereof. The stepped portion 71 limits the movement of the nozzle body 40. When the retaining nut 70 is fitted to the holder 60, the nozzle body 40 and the orifice member 50 is pressed toward the side of the holder 60. The holder 60 and the retaining nut 70 hold the nozzle body 40 and the orifice member 50 to be fixed in an axial direction thereof. The holder 60 and the retaining nut 70 are fixing members for fixing the nozzle body 40 and the orifice member 50 in the axial direction thereof.

The nozzle needle 90 is made of a metal material such as high-speed tool steel and is configured in a generally cylindrical shape. The nozzle needle 90 includes a piston portion 91, sliding contact portions 92, and a seat portion 93. The piston portion 91 is a portion of the cylindrical outer surface of the nozzle needle 90 which is located inside the cylinder 80. The piston portion 91 is arranged within the cylinder 80 to be slidably supported by an inner wall of the cylinder 80. The sliding contact portions 92 are arranged one after another at equal intervals on an outer circular peripheral surface of the nozzle needle 90. The sliding contact portions 92 are in contact with the inner surface of the nozzle body 40. The sliding contact portions 92 allow the nozzle needle 90 to slide along the axial direction thereof in the nozzle body 40. The seat portion 93 is arranged at one of two end surfaces of the nozzle needle 90 in an axial direction thereof, which is opposite from the pressure chamber 34. The seat portion 93 can be seated on the valve seat portion 42. The seat portion 93 and valve seat portion 42 configure the main valve 12 that allows or interrupts the flow of the high-pressure fuel to the injection holes 11 in the nozzle needle housing portion 41. A circular collar member 96 is set to the stepped portion of the nozzle needle 90. The nozzle needle 90 is also referred to as a valve member. The nozzle needle 90 moves in the nozzle body 40 in the axial direction thereof to allow or interrupt the flow of the high-pressure fuel to the injection holes 11.

A return spring 97 is provided between the cylinder 80 and the nozzle needle 90 in a compressed state. The cylinder 80 is in contact with the orifice member 50 such that the return spring 97 is provided between the orifice member 50 and the nozzle needle 90. The nozzle needle 90 is biased to a valve closing side by a return spring 97. The return spring 97 is a coil spring. One axial direction end of the return spring 97 contacts the collar member 96, and the other end of the return spring 97 contacts the end surface of the cylinder 80. The nozzle needle 90 reciprocates along the axial direction of the cylinder 80 with response to the pressure difference between the fuel pressure applied to the piston portion 91 and the pressure of the high-pressure fuel flowing into the nozzle needle housing portion 41. The nozzle needle 90 makes the seat portion 93 to be seated on and separated from the valve seat portion 42 to control the opening and closing of the main valve 12.

The floating plate 100 is held within the cylinder 80. The floating plate 100 is a control member to control the flow of the fuel that is introduced into and discharged from the pressure chamber 34. The floating plate 100 forms the control valve 13 together with the driving part 20 and the pressure control valve 27. The floating plate 100 is a cylindrical shaped member made of a metal material. The floating plate 100 is arranged to be smoothly slidable in the pressure chamber 34. A center axis of the floating plate 100 is located along a center axis of the cylinder 80. The floating plate 100 is arranged coaxially with the cylinder 80. The floating plate 100 is arranged to be capable of reciprocating in the axial direction thereof. One of end surfaces of the floating plate 100, which is opposed to the abutting surface 51, can contact the abutting surface 51. A sufficiently large clearance is defined between an outer circular peripheral surface of the floating plate 100 and an inner surface of the cylinder 80 to allow fuel to pass between them. A communication hole 101 is defined at a center portion of the floating plate 100 to penetrate through the floating plate 100 in the axial direction thereof. The communication hole 101 causes the pressure chamber 34 to communicate with the outflow passage 32. The communication hole 101 is also a throttle portion. The communication hole 101 limits the amount of the fuel flowing through the communication hole 101.

When the floating plate 100 is separated from the abutting surface 51, the fuel flows from the inflow port 31*a* into the pressure chamber 34 through a clearance between the floating plate 100 and the cylinder 80. When the floating plate 100 is in contact with the abutting surface 51, the fuel flows from the pressure chamber 34 through the communication hole 101 and flows out of the outflow port 32*a*. When the floating plate 100 is in contact with the abutting surface 51, the communication between the inflow port 31*a* and the pressure chamber 34 is interrupted. The floating plate 100 and the orifice member 50 provide a channel switching valve, which switches between the introduction of the high-pressure fuel flowing into the pressure chamber 34 and the discharge of the fuel flowing out of the pressure chamber 34.

The floating plate 100 is a pressure-response type control member that is moved based on the amount of the pressure controlled with the pressure control valve 27. The floating plate 100 arranged within the pressure chamber 34 contacts and separates from the orifice member 50 to allow or interrupt the communication between the inflow passage 31 and the pressure chamber 34. In addition, a radial location of the floating plate 100 is determined with the nozzle body 40. The orifice member 50 and the floating plate 100 form the flat sealing surface that allows or interrupts the communication between the inflow passage 31 and the pressure chamber 34.

A plate spring 110 is a coil spring. An axial direction end of the plate spring 110 is seated on the end surface of the floating plate 100. The other end of the plate spring 110 is seated on a pressure receiving surface 94. The plate spring 100 is provided between the floating plate 100 and the nozzle needle 90 in a compressed state. The plate spring 110 causes the floating plate 100 to be biased to the side of the abutting surface 51.

In FIG. 3, an inner surface of the cylinder 80 forms an inner wall surface 81 that exposed to the pressure chamber 34 in the control body 30. The inner wall surface 81 forms an enlarged diameter portion 82 and a reduced diameter portion 83. The enlarged diameter portion 82 is located at the side of the orifice member 50. The inflow port 31*a* and the outflow port 32*a* are located in an inside of the enlarged diameter portion 82. The reduced diameter portion 83 is located at a side that is opposite from the orifice member 50 in the axial direction of the cylinder 80 with respect to the floating plate 100. The reduced diameter portion 83 holds the end portion of the nozzle needle 90 to be slidable along an axial direction thereof. The reduced diameter portion 83 forms a cylinder side sliding surface. The reduced diameter portion 83 forms a cylinder bore. With reference to an inner diameter of the cylinder 80, an inner diameter of the reduced diameter portion 83 is smaller than an inner diameter of the enlarged diameter portion 82.

The cylinder 80 holds the piston portion 91 arranged at the end portion of the nozzle needle 90. The cylinder 80 is set to be pressed toward the orifice member 50, and thereby it defines the pressure chamber 34 together with the orifice member 50.

The piston portion 91 is located in an inside of the reduced diameter portion 83. The piston portion 91 is held to be slidable relative to the reduced diameter portion 83. The piston portion 91 forms the pressure receiving surface 94 and the spring housing portion 95. The pressure receiving surface 94 is formed of the one of two axial direction end portions of the nozzle needle 90, which is located at the side of the pressure chamber 34 that is opposite from the seat portion 93. The pressure receiving surface 94 defines the pressure chamber 34. The pressure receiving surface 94 receives fuel pressure in the pressure chamber 34. The spring housing portion 95 is a cylindrical hole formed coaxially with the nozzle needle 90 in the radial central portion of the pressure receiving surface 94. The spring housing portion 95 holds a portion of the plate spring 110.

The floating plate 100 is held within the enlarged diameter portion 82. A sufficiently large clearance is defined between the outer circular peripheral surface of the floating plate 100 and an inner surface of the enlarged diameter portion 82 of the cylinder 80 to allow fuel to pass therebetween.

The fuel supply system 1 supplies the high-pressure fuel to fuel injection device 10. The fuel injection device 10 injects fuel based on the signals from the ECU 7.

When the ECU 7 does not output the signals, the pressure control valve 27 is blocked. The high-pressure fuel is supplied to an inside of the nozzle needle housing portion 41. On the other hand, the high-pressure fuel supplied from the inflow port 31*a* to the inflow recess portion 53 causes the floating plate 100 to separate from the abutting surface 51. At this time, the inside pressure of the outflow recess portion 54 becomes equal to that of the pressure chamber 34 due to the communication between the recess portion 54 and the pressure chamber 34 through the communication hole 101. Therefore, the high-pressure fuel in the inflow recess portion 53 presses the floating plate 100 down, thereby flowing into the pressure chamber 34. When the inside pressure of the pressure chamber 34 is raised, the floating plate 100 is seated on the abutting surface 51. The difference between the inside pressure of the nozzle needle housing portion 41 and the inside pressure of the pressure chamber 34 is small. Therefore, the nozzle needle 90 is seated on the valve seat portion 42 to block fuel injection from the injection holes 11.

When the magnetic field of the solenoid 21 is generated with the signals from the ECU 7, the pressure control valve 27 is opened. When the pressure control valve 27 is opened, the inside fuel of the pressure chamber 34 is discharged through the communication hole 101. Therefore, the inside fuel pressure of the pressure chamber 34 is reduced. At this time, inside pressure of the outflow recess portion 54 is low, so that the floating plate 100 remains to be seated on the abutting surface 51. When the inside fuel pressure of the pressure chamber 34 becomes low, the high-pressure fuel supplied into the nozzle needle housing portion 41 urges the nozzle needle 90 toward the side of the pressure chamber 34 with high speed with resistance to the force of the return spring 97. As a result, the nozzle needle 90 is separated from the valve seat portion 42 to start the fuel injection from the injection holes 11.

When the magnetization of the solenoid 21 is stopped based on the signals from the ECU 7, the pressure control valve 27 is closed. Therefore, the inside pressure of the outflow recess portion 54 becomes equal to the inside pressure of the pressure chamber 34 due to the communication between the recess portion 54 and the pressure chamber 34 caused by the communication hole 101. As a result, the high-pressure fuel supplied into the inflow recess portion 53 from the inflow port 31*a* presses the floating plate 100 slightly down, thereby flowing into the pressure chamber 34. When the inside pressure of the pressure chamber 34 is raised, the floating plate 100 is seated on the abutting surface 51. When the inside pressure of the pressure chamber 34 is raised, the nozzle needle 90 is seated on the valve seat portion 42 to block the fuel injection from the injection holes 11.

In FIG. 3, the structure of the fuel injection device 10 for accurately setting the orifice member 50 and the floating plate 100 to proper locations will be described. The enlarged diameter portion 82 of the cylinder 80 guides the floating plate 100. Therefore, the radial location of the floating plate 100 is set by the enlarged diameter portion 82. The radial location of the cylinder 80 is set by the piston portion 91 of the nozzle needle 90. Furthermore, the radial location of the nozzle needle 90 is set by the nozzle body 40. Therefore, for accurately setting the radial location of the floating plate 100 relative to the orifice member 50, it is necessary to accurately set the locations of the orifice member 50 and the nozzle body 40.

The orifice member 50 includes a large circular peripheral surface 56 and a small circular peripheral surface 57. The large circular peripheral surface 56 is located at the side of the holder 60. The small circular peripheral surface 57 is located at the side of the nozzle body 40. The diameter of the small circular peripheral surface 57 is smaller than that of the large circular peripheral surface 56. A stepped portion, which has the radial direction width RW, is formed between the large circular peripheral surface 56 and the small circular peripheral surface 57. The stepped portion includes an annular stepped surface 58. The small circular peripheral surface 57 is an outer circular peripheral surface of a column that extends along the axial direction of the fuel injection device 10. The small circular peripheral surface 57 is the outer circular peripheral surface of the column and formed coaxially with the orifice member 50. The inflow recess portion 53 and the outflow recess portion 54, which define the contact surface between the orifice member 50 and the floating plate 100, are formed coaxially with the orifice member 50. The small circular peripheral surface 57 is located radially outside the sealing surface 55. The small circular peripheral surface 57 is used as a first circular peripheral surface 57.

A circular peripheral surface 44 is arranged at the end portion of the nozzle body 40 adjacent to the orifice member 50. The circular peripheral surface 44 is an outer peripheral surface of a column that extends along the axial direction of the fuel injection device 10. The circular peripheral surface 44 is the outer peripheral surface of the column that is formed coaxially with the nozzle body 40. The nozzle needle housing portion 41, which indirectly defines the radial location of the floating plate 100, is formed coaxially with the orifice member 50. The circular peripheral surface 44 is used as a second circular peripheral surface 44. The diameter of the second circular peripheral surface 44 is equal to that of the first circular peripheral surface 57.

An annular positioning member 120 is provided at the radially outer side of the first circular peripheral surface 57 and the second circular peripheral surface 44. The inner diameter of the positioning member 120 is slightly greater than the outer diameter of the first circular peripheral surface 57 and the outer diameter of the second circular peripheral surface 44. The first circular peripheral surface 57 contacts almost entire inner peripheral surface of the positioning member 120. The second circular peripheral surface 44 contacts almost entire inner peripheral surface of the positioning member 120. The positioning member 120 is fitted to the second circular peripheral surface 44 of the nozzle body 40, and is fitted to the first circular peripheral surface 57 of the orifice member 50. The positioning member 120 is a positioning member that set the radial locations of the nozzle body 40 and the orifice member 50.

The positioning member 120 is fitted to the outer circular peripheral surface 44 of the nozzle body 40, and is fitted to the outer circular peripheral surface 57 of the orifice member 50. The positioning member 120 is the only one positioning member for setting the radial locations of the nozzle body 40 and the orifice member 50.

The positioning member 120 allows the rotation of the nozzle body 40 relative to the orifice member 50. Portions defined between the nozzle body 40 and the orifice member 50, to which fuels having different pressure are supplied respectively, are formed coaxially with the fuel injection device 10 to be separated from each other. Specifically, the passages 31, 32, 33 are opened at the end surface of the orifice member 50 to be separated from each other at equal intervals in a radial direction of the fuel injection device 10 from the center axis thereof. Furthermore, the inflow recess portion 53, the outflow recess portion 54, the pressure chamber 34 and the nozzle needle housing portion 41 are located coaxially with the fuel injection device 10. Therefore, if the nozzle body 40 is rotated relative to the orifice member 50, the function of the fuel injection device 10 can be maintained.

Moreover, the retaining nut 70 used as a fixing member is located to cover both the nozzle body 40 and the orifice member 50, and located in the radially outside of the positioning member 120. The positioning member 120 is held by the retaining nut 70 in an axial direction thereof.

Figure 4:
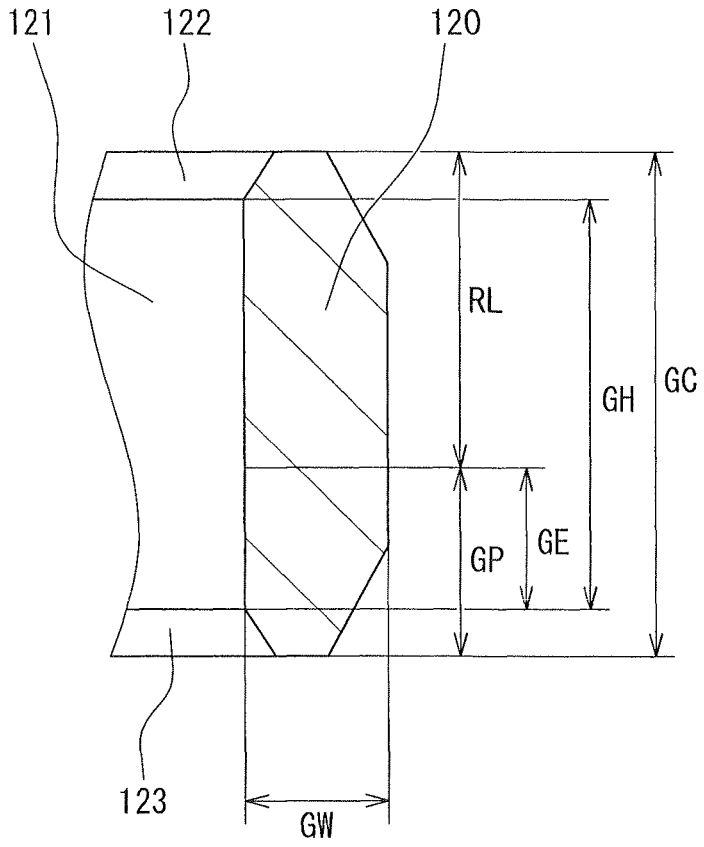
FIG. 4 is an enlarged cross-sectional view of the fuel injection device of the first embodiment.

FIG. 4 is an enlarged cross-sectional view of the fuel injection device showing the positioning member 120. The positioning member 120 is made of a metal material and has a cylindrical shape. The positioning member 120 has two enlarged inner diameter portions at both ends. The diameters of the enlarged inner diameter portions become larger toward the ends of the positioning member 120. The positioning member 120 has an inner circular peripheral surface 121 and slope 122, 123. The inner circular peripheral surface 121 is an inner surface of a cylinder hollow that contacts the first circular peripheral surface 57 and the second peripheral surface 44 to set the locations of the nozzle body 40 and the orifice member 50. The length GH of the inner circular peripheral surface 121 is an effective length of the positioning member 120. When the positioning member 120 is held in the retaining nut 70 and the retaining nut 70 is screwed with a proper location, the first peripheral surface 57 and the second peripheral surface 44 are located within the range of the length GH in the axial direction. The radial width GW of the positioning member 120 and the width RW of the stepped surface 58 of the orifice member 50 satisfy the following equation $GW<RW$. The radial width GW and the width RW can be set to satisfy the following equation $GW \leq RW$.

The slope 122 is inclined with respect to the inner circular peripheral surface 121 to make the width of the positioning member 120 become smaller toward the axial end thereof. The slope 122 provides an enlarged inner diameter portion, in which the diameter becomes larger from the side of the inner circular peripheral surface 121 to the end of the positioning member 120. When the slope 122 and the orifice member 50 are connected to each other, the slope 122 guides the first peripheral surface 57 toward the inner circular peripheral surface 121. Therefore, the slope 122 guides the orifice member 50 to the fitting location of the orifice member 50 and the positioning member 120.

The slope 123 is inclined with respect to the inner circular peripheral surface 121 to make the width of the positioning member 120 become smaller toward the axial end thereof. The slope 123 provides an enlarged inner diameter portion, in which the diameter becomes larger from the side of the inner circular peripheral surface 121 to the end of the positioning member 120. When the positioning member 120 and the nozzle body 40 are connected to each other, the slope 122 guides the second peripheral surface 57 toward the inner circular peripheral surface 121. Therefore, the slope 123 guides the nozzle body 40 to the fitting location of the nozzle body 40 and the positioning member 120.

The manufacturing method and processes of the fuel injection device 10 will be described below. In a preparation process, the components such as the nozzle body 40, the orifice member 50 and the positioning member 120 are formed as shown in the drawings. Then, the orifice member 50 is fitted to the positioning member 120. At this time, the slope 122 guides the first peripheral surface 57 toward the inner circular peripheral surface 121. The positioning member 120 is disposed to contact the stepped surface 58. The stepped surface 58 is used as a stopper for limiting the movement of the positioning member 120. The stepped surface 58 sets the axial position of the positioning member 120. The axial length GC of the positioning member 120 and the axial length RL of the first peripheral surface 57 adjacent to the stepped surface 58 satisfy the following equation GC>RL. Therefore, when the positioning member 120 is fitted to the orifice member 50, the inner circular peripheral surface 121 of the positioning member 120 projects from the orifice member 50. The projecting length GP of the positioning member 120 includes the axial length of the inner circular peripheral surface 121 and the slope 123. The nozzle body 40 is set at the proper location by the positioning member 120 with a portion having the effective length GE of the inner circular peripheral surface 121.

The nozzle needle 90, the collar member 96, the return spring 97, the cylinder 80, the plate spring 110, and the floating plate 100 are fitted in the nozzle body 40. At this time, the return spring 97 and the plate spring 110 have free length, respectively. Therefore, the cylinder 80 and the floating plate 100 project from the end surface of the nozzle body 40.

Then, the nozzle body 40 installed with the components, such as the return spring 97, is temporarily fitted to the orifice member 50. In the temporary assembling process, the second peripheral surface 44 is inserted into the positioning member 120 through the side of the slope 123. At this time, the second peripheral surface 44 is in contact with the orifice member 50 and gradually compresses the plate spring 110 to be inserted into the positioning member 120. The second peripheral surface 44 is inserted into the positioning member 120 until the cylinder 80 contacts the orifice member 50.

The plate spring 110 is more compressible than the return spring 97. Therefore, at the time of temporarily assembling the nozzle body 40 in the positioning member 120, the plate spring 110 is easy to be compressed, however, the return spring 97 is hardly compressed. The plate spring 110 is possible to be compressed by the weight of the nozzle body 40 and the nozzle needle 90. When no weight is applied to the return spring 97, the return spring 97 has a free length SF. In the assembled state of the return spring 97 as shown in HG. 3, the return spring 97 has a compressed length SC. The difference between the free length SF and the compressed length SC is a compression amount SP of the return spring 97. When the nozzle body 40 is temporarily assembled to the orifice member 50, the cylinder 80 projects from the end surface of the nozzle body 40 by the compression amount SP. Therefore, in the temporarily assembled state, the first peripheral surface 57 and the second peripheral surface 44 are separated from each other in the axial direction thereof by the compression amount SP.

The projecting length GP of the positioning member 120 is set such that the nozzle body 40 and the orifice member 50 are located within the inner circular peripheral surface 121 to set its radial position even in the temporarily assembled state. The projecting length GP is set such that when only the cylinder 80 contacts the cylinder member 50, the second peripheral surface 44 reaches the inner circular peripheral surface 121. Specifically, the axial length RL of the first peripheral surface 57 and the axial length GC of the positioning member 120 are set such that the length GP of the projection of the positioning member 120 projecting in the axial direction thereof from the first peripheral surface 57 is greater than the compression amount SP of the return spring 97 such that GP>SP. More specifically, the effective length GE and the compression amount SP of the return spring 97 are set such that GE>SP. Therefore, in the temporarily assembled state, i.e., before the return spring 97 is compressed, the orifice member 50 and the nozzle body 40 can be set to the proper locations, respectively.

Next, the retaining nut 70 is screwed to the orifice member 50 and the nozzle body 40. In the process of screwing the retaining nut 70, the return spring 97 is gradually compressed. When the nozzle body 40 directly contacts the orifice member 50, the process of screwing the retaining nut 70 is finished. The positioning member 120 is provided between the orifice member 50 and the retaining nut 70 in the axial direction thereof to be held therebetween. More specifically, the positioning member 120 is held on a gap between the stepped surface 58 and the retaining nut 70 in the axial direction thereof.

In the present embodiment, the manufacturing method of the fuel injection device 10 includes the above described manufacturing processes. Therefore, the nozzle body 40 and the orifice member 50 are accurately set at the proper locations in the radial direction thereof, while the nozzle body 40 and the orifice member 50 are assembled.

Figure 5:
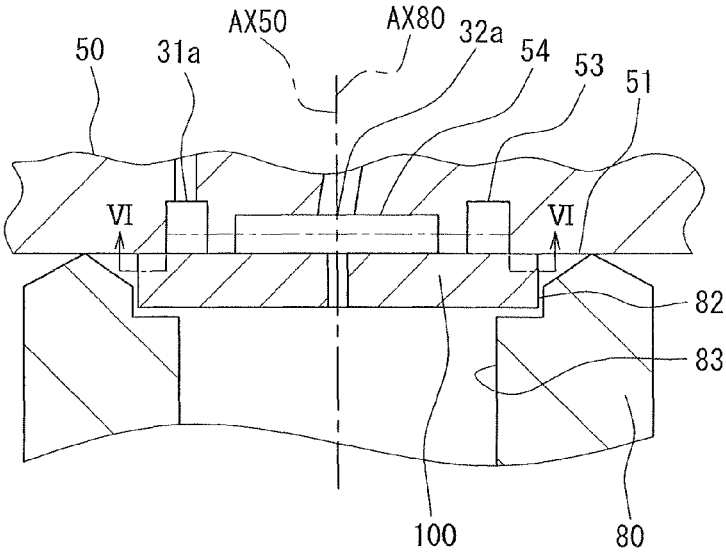
FIG. 5 is an enlarged cross-sectional view of a proper alignment of the fuel injection device in the first embodiment.
Figure 6:
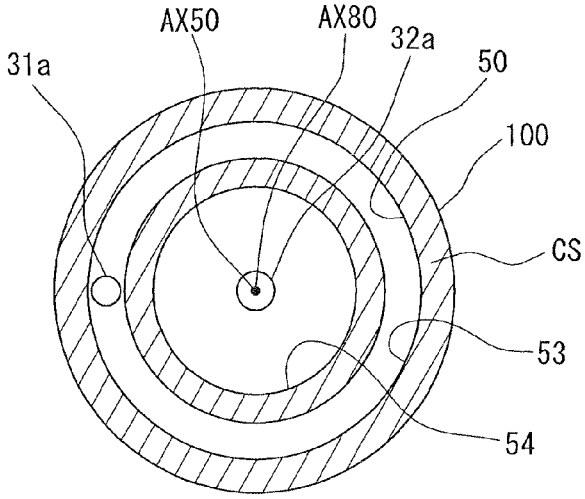
FIG. 6 is a plane view of the proper alignment of the fuel injection device of the first embodiment.
Figure 7:
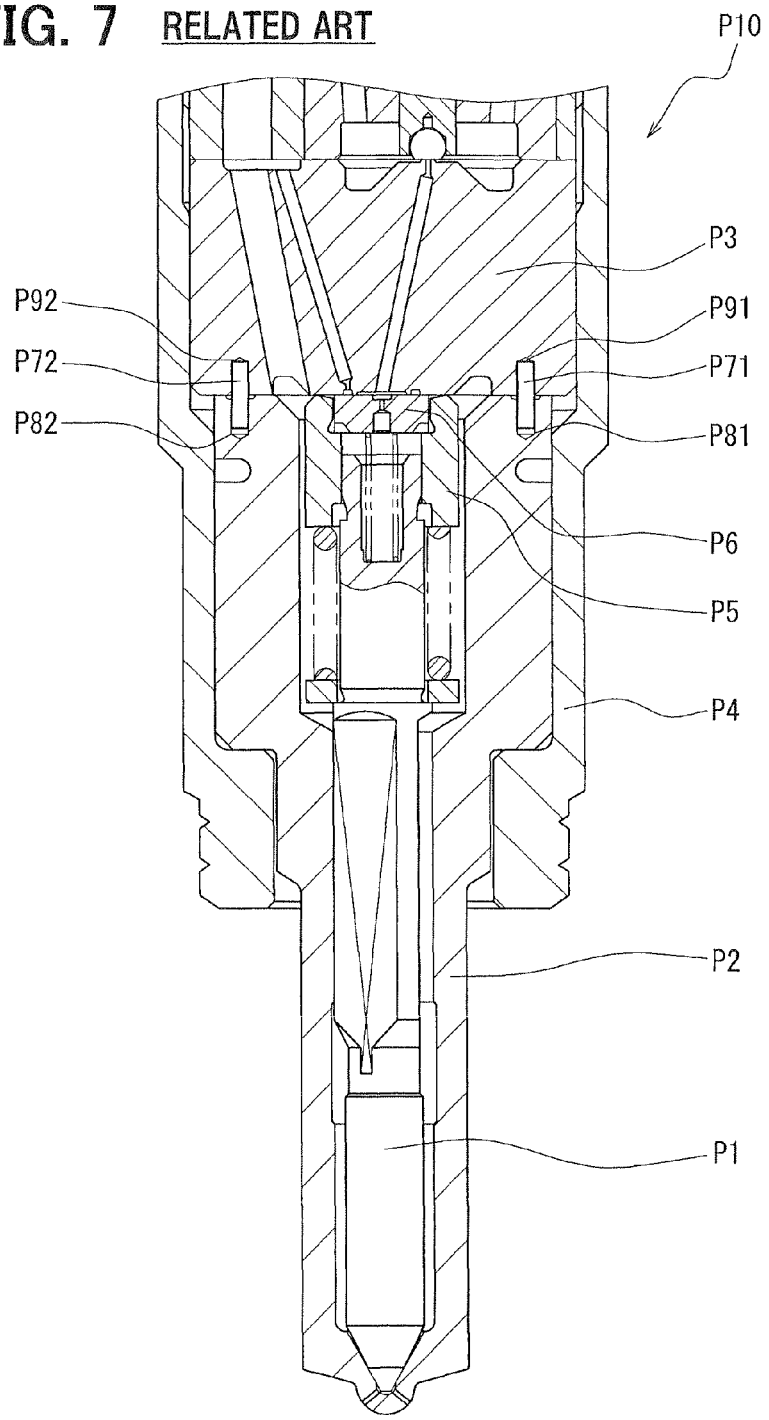
FIG. 7 RELATED ART
FIG. 7 is a cross-sectional view of a fuel injection device of a comparative example.
Figure 8:
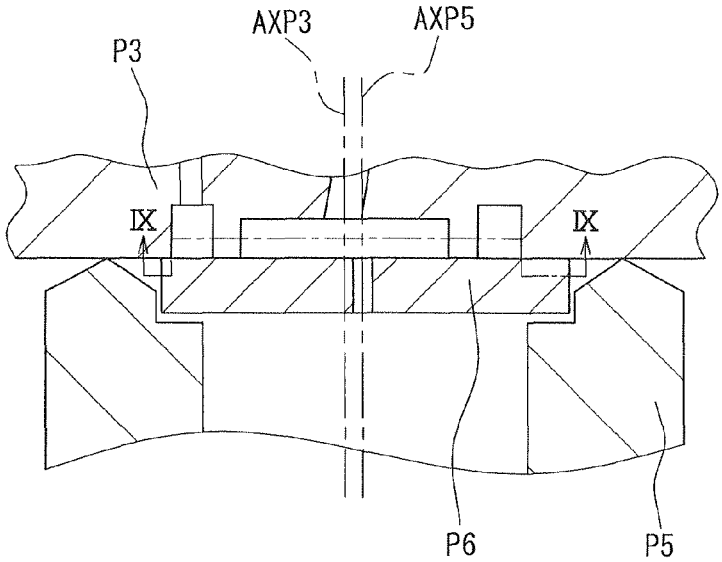
FIG. 8 RELATED ART
FIG. 8 is an enlarged cross-sectional view of the fuel injection device of the comparative example that has a gap between components.
Figure 9:
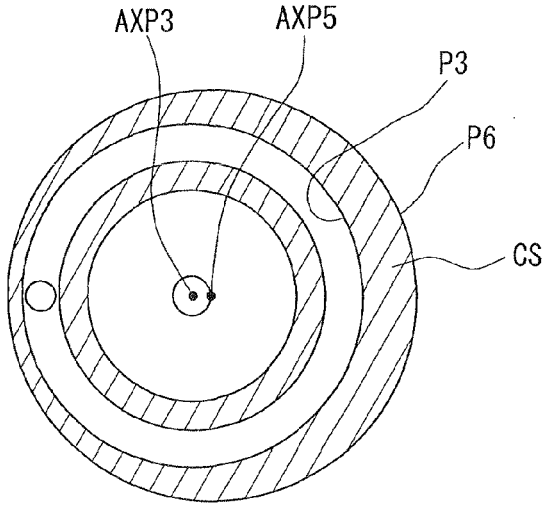
FIG. 9 RELATED ART
FIG. 9 is a plane view of the fuel injection device of the comparative example that has a gap between components.

FIG. 5 is an enlarged cross-sectional view of a proper alignment of the fuel injection device 10 of the first embodiment. FIG. 6 is a plane view of the proper alignment of the fuel injection device 10 of the first embodiment. In the present embodiment, the nozzle body 40 and the orifice member 50 are lined by the positioning member 120 with reference surfaces, i.e., the circular peripheral surface 44 of the nozzle body 40 and the circular peripheral surface 57 of the orifice member 50. The peripheral surfaces are formed with high accuracy relative to the center axis of the components. The positioning member 120 makes the center of the nozzle body 40 to be accurately coaxial to the center axis of the orifice member 50. Therefore, the nozzle body 40 and the orifice member 50 are set at the proper locations respectively with high accuracy.

When the nozzle body 40 and the orifice member 50 are set at the proper locations, the center axis AX50 of the orifice member 50 is coaxial with a center axis AX80 of the cylinder 80. Therefore, the floating plate 100 is set at the proper location relative to the orifice member 50 with high accuracy.

Specifically, the location of the floating plate 100 on the abutting surface 51 is the proper location of the floating plate 100. As shown in FIG. 6, the orifice member 50 is coaxial with a contact surface CS of the floating plate 100. The contact surface CS is the flat sealing surface arranged between the orifice member 50 and the floating plate 100. Therefore, fuel flows along the circumferential direction in the floating plate 100, and fuel pressure is applied to the floating plate 100. As a result, the motion of the floating plate 100 is stabilized. In addition, the fuel injection characteristic is stabilized. Furthermore, high accuracy can be achieved with high productivity structure in the fuel injection device 10.

Second Embodiment

Figure 10:
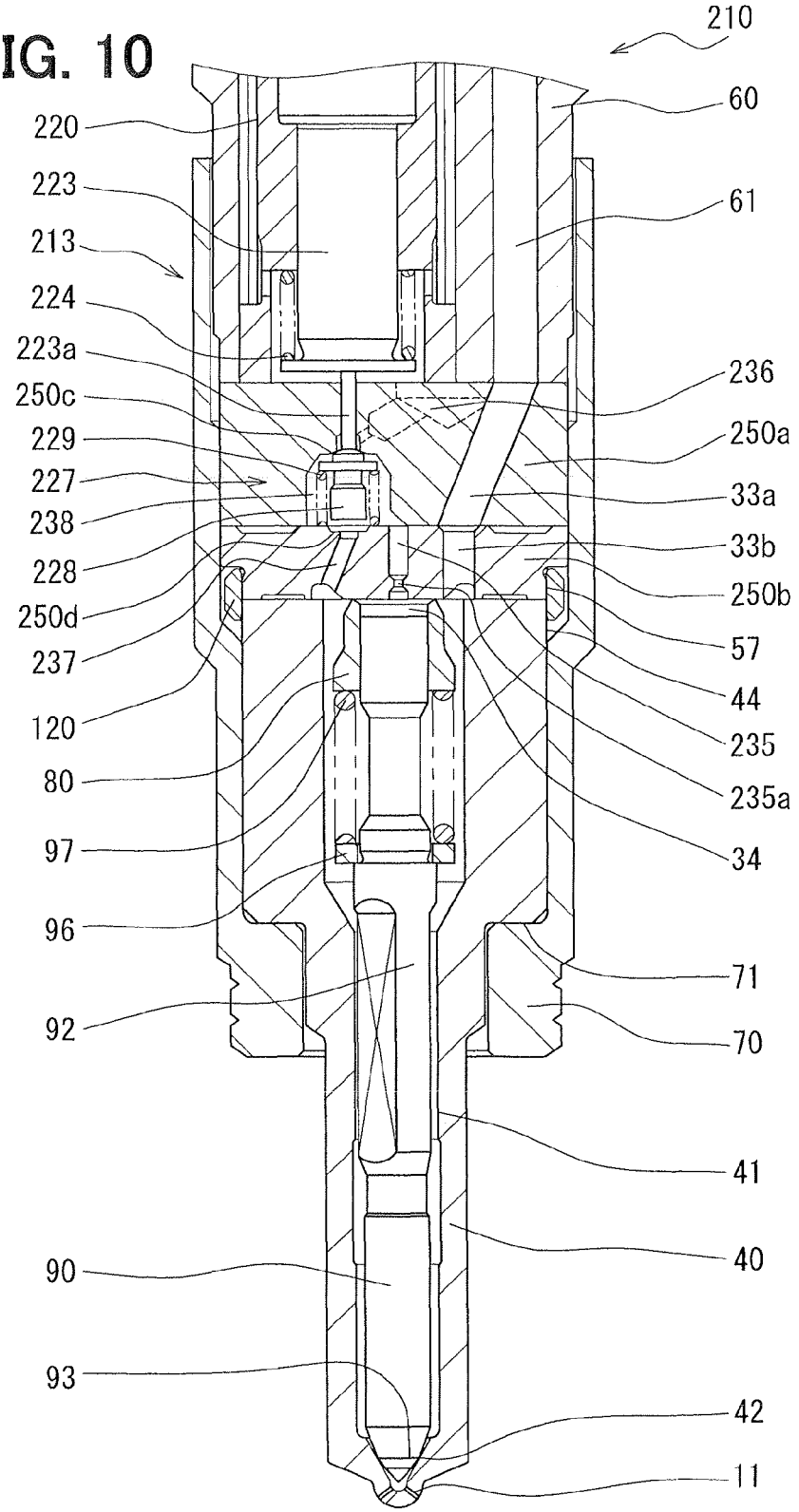
FIG. 10 is an enlarged cross-sectional view of a fuel injection device of a second embodiment according to the present invention.

FIG. 10 is an enlarged cross-sectional view of a fuel injection device 210 of a second embodiment according to the present invention. In the following embodiments, similar components will be indicated by the same reference numerals and will not be described redundantly for the sake of simplicity. The details of the similar components are referred in the above described embodiment. The fuel injection device 210 can be applied to the fuel supply system 1 instead of the fuel injection device 10.

The fuel injection device 210 includes orifice members 250*a*, 250*b*, instead of the orifice member 50 of the first embodiment. The orifice members 250*a*, 250*b* are formed in a column shape or a circular disk shape to be stacked with each other in an axial direction. The orifice members 250*a*, 250*b* define a plurality of fuel passages. In the orifice members 250*a*, 250*b*, main supply passages 33*a*, 33*b* are defined to cause the longitudinal hole 61 to communicate with the nozzle needle housing portion 41.

The fuel injection device 210 does not include the floating plate 100 described in the above first embodiment. The fuel injection device 210 is equipped with a control valve 213. The control valve 213 includes a pressure control valve 227 instead of the floating plate 100. The control valve 227 is controlled directly by a driving portion 220. The driving portion 220 uses a piezo-electric element as an actuator. The driving portion 220 moves a rod 223*a* with a piston 223 in the up and down direction in FIG. 10. The pressure control valve 227 switches a high-pressure state and a low-pressure state in the pressure chamber 34 to drive the nozzle needle 90. The pressure control valve 227 is held between the orifice members 250*a*, 250*b*. The orifice member 250*a* includes a recess portion 238 that holds the pressure control valve 227. The recess portion 238 includes a valve body 228 and a spring 229. The valve body 228 is possible to move in the axial direction of the fuel injection device 210 within the recess portion 238. The spring 229 presses the valve body 228 in the axial direction thereof. The valve body 228 can move between a first position for setting the inside of the pressure chamber 34 at a high-pressure state and a second position for setting the inside of the pressure chamber 34 at a low-pressure state.

The orifice member 250*b* includes a common supply passage 235 to cause the pressure control valve 227 to communicate with the pressure chamber 34. The common supply passage 235 causes the recess portion 238 to communicate with the pressure chamber 34 at any time. The common supply passage 235 is a commonly used passage for controlling the flow of the fuel that flows into and flows out of the pressure chamber 34. The common supply passage 235 includes a throttle 235*a* that limits the amount of the fuel flow.

A low-pressure passage 236 is defined in the orifice member 250*a*. The low-pressure passage 236 causes the pressure control valve 227 to communicate with the return channel 8*d*. The low-pressure passage 236 is opened on the recess portion 238. The low-pressure passage 236 can be used as an outflow passage. A valve seat 250*c* is provided around the opening of the low-pressure passage 236 in the recess portion 238. The valve body 228 can be seated on the valve seat 250*c*. The valve body 228 and the valve seat 250*c* form a valve member that allows or interrupts the communication between the recess portion 238 and the low-pressure passage 236. When the valve body 228 is located at the first position, the valve body 228 is seated on the valve seat 250*c* to interrupt the communication between the recess portion 238 and the low-pressure passage 236. When the valve body 228 is located at the second position, the valve body 228 is separated from the valve seat 250*c* to allow the communication between the recess portion 238 and the low-pressure passage 236.

An inflow passage 237 is defined in the orifice member 250*b*. The inflow passage 237 causes the nozzle needle housing portion 41 to communicate with the pressure control valve 227. The inflow passage 237 is opened on the recess portion 238. A valve seat 250*d* is provided around the opening of the inflow passage 237 in the recess portion 238. The valve body 228 can be seated on the valve seat 250*d*. The valve body 228 and the valve seat 250*d* form a valve member that allows or interrupts the communication between the recess portion 238 and the inflow passage 237. When the valve body 228 is located at the first position, the valve body 228 is separated from the valve seat 250*d* to allow the communication between the recess portion 238 and the inflow passage 237. When the valve body 228 is located at the second position, the valve body 228 is seated on the valve seat 250*d* to interrupt the communication between the recess portion 238 and the inflow passage 237.

The valve body 228 is directly controlled by the driving portion 220. The rod 223*a* is provided between the piston 223 and the valve body 228. The piston 223 is pressed toward the down direction in FIG. 10, i.e., the direction to press the valve body 228 toward the second position, by the spring 224. On the other hand, the valve body 228 is pressed toward the upper direction in FIG. 10, i.e., the direction to press the valve body 228 toward the first position, by the spring 229. The springs 224, 229 are set to make the valve body 228 located in the first position when the high-pressure fuel is supplied in the fuel injection device 210.

In the present embodiment, the positioning member 120 is also used in the fuel injection device 210. The positioning member 120 is fitted to the outer circular peripheral surface 57 of the orifice member 250*b*. Furthermore, the positioning member 120 is fitted to the outer circular peripheral surface 44 of the nozzle body 40.

The positioning member 120 is only one positioning member that sets the radial locations of the nozzle body 40 and the orifice member 250*b*. The positioning member 120 allows the rotation of the nozzle body 40 relative to the orifice member 250*b*. Portions defined between the nozzle body 40 and the orifice member 250*b*, to which the fuel having different pressure are supplied respectively, are formed coaxially with the fuel injection device 210 to be separated from each other. Specifically, the passages 33*b*, 235 are opened at the end surface of the orifice member 250*b* to be separated from each other at equal intervals in a radial direction of the fuel injection device 210 from the center axis thereof. Furthermore, the pressure chamber 34 and the nozzle needle housing portion 41 are located coaxially with the fuel injection device 210. Therefore, if the nozzle body 40 is rotated relative to the orifice member 250*b*, the function of the fuel injection device 210 can be maintained.

Positioning members (not shown), such as pins, are provided between the orifice member 250*a* and the orifice member 250*b* and between the orifice member 250*a* and the holder 60 to position the orifice members 250*a* and the holder 60 in the radial direction and the rotational direction thereof.

The piston portion 91 provided at the end of the nozzle needle 90 is held in the cylinder 80. The cylinder 80 is set to be pressed toward the orifice member 250*b*, and thereby the cylinder 80 defines the pressure chamber 34 together with the orifice member 250*b*. The radial location of the cylinder 80 is defined by the nozzle needle 90. Furthermore, the radial location of the nozzle needle 90 is defined by the nozzle body 40. The radial location of the cylinder 80 is defined by the nozzle body 40 with the nozzle needle 90. The nozzle body 40 and the orifice member 250*b* are positioned accurately to the proper locations with the positioning member 120, and thereby the cylinder 80 is also positioned accurately relative to the orifice member 250*b*.

In the present embodiment, when the driving portion 220 is activated, the piston 223 moves to a downside direction in FIG. 10. Therefore, the valve body 228 moves from the first position to the second position. As a result, the fuel flows from the pressure chamber 34 to the low-pressure passage 236, and thereby the nozzle needle 90 moves to the upper direction in FIG. 10 to inject the fuel. When the driving portion 220 is not activated, the piston 223 moves to an upper direction in FIG. 10. Therefore, the valve body 228 moves from the second position to the first position. As a result, the fuel flows from the inflow passage 237 to the pressure chamber 34, and thereby the nozzle needle 90 moves to the downside direction in FIG. 10 to interrupt the fuel injection.

In the present embodiment, the nozzle body 40 and the orifice member 250*b* are set at the proper locations respectively with high accuracy by the positioning member 120. Therefore, the components are accurately set at the proper locations in the radial direction thereof relative to each other. Furthermore, the one positioning member 120 is used in the present embodiment, so that the high productivity can be achieved. Moreover, instability of the fuel injection characteristic, which is caused by the dislocation of the nozzle body 40 and the orifice member 250*b*, can be limited in the present embodiment. Moreover, the cylinder 80 is set accurately relative to the orifice member 250*b*, so that the instability of the fuel injection characteristic that is caused by the dislocation of the nozzle body 40 and the orifice member 250*b* can be limited.

Other Embodiments

The preferred embodiments of the present invention have been described. However, the present invention is not limited to the above embodiments, and the above embodiments may be modified in various ways without departing from the spirit and scope of the invention. The configurations of the above-described components are examples and not limited to the configuration of the first embodiment. Furthermore, the components of the above embodiment and the modifications thereof may be combined in any appropriate manner within the spirit and scope of the present invention.

For example, the inner diameter of the positioning member 120 can be set to become smaller than outer diameter of the first peripheral surface 57. In this case, the first peripheral surface 57 is fixed to the positioning member 120 by press fitting. Furthermore, the inner diameter of the positioning member 120 can be set to become smaller than outer diameter of the second peripheral surface 44. In this case, the second peripheral surface 44 is fixed to the positioning member 120 by press fitting.

A stepped portion can be formed in the nozzle body 40 similar to the case of the orifice member 50, and the circular peripheral surface 44 can be formed by the small diameter portion of the nozzle body 40. Furthermore, the stepped portion can be arranged on only the nozzle body 40 instead of the orifice member 50 to provide the circular peripheral surface 44. In this case, the axial location of the positioning member 120 is set by the nozzle body 40.

The outer diameter of the first peripheral surface 57 and the outer diameter of the second peripheral surface 44 can be formed in different sizes, and it is possible to make the inner surface of the positioning member 120 with a stepped surface that is formed by the enlarged diameter portion and the small diameter portion, which correspond to the circular peripheral surfaces 57, 44 respectively. Furthermore, the first peripheral surface 57 and the second peripheral surface 44 can include a key groove to define the location in the rotation direction thereof.

The first peripheral surface 57 and the second peripheral surface 44 can be partially conical surfaces that have slightly inclined slopes relative to the axial direction thereof. For example, the circular peripheral surface 57 arranged on the orifice member 50 can be the partially conical surface in which its outer diameter gradually becomes smaller toward the end portion thereof. The concept of the above described peripheral surfaces includes partially conical surfaces.

In the above described embodiment, the slopes 122, 123 are arranged on the both ends of the positioning member 120, respectively. Instead of the above described configuration, the positioning member 120 can include the only one slope, i.e., the slope 122 or the slope 123, at one side of the end portions.

In the above described embodiment, the circular peripheral surface 44 arranged on the nozzle body 40 is an outer peripheral surface. Instead of the above described configuration, a cylindrical portion can be formed at the end portion of the nozzle body 40, and then an inner circular peripheral surface is arranged at an inside of the cylindrical portion. In the above described modification example, the positioning member is provided in an inside of the inner circular peripheral surface to be fixed to the inner circular peripheral surface. In addition, in the above described embodiment, the circular peripheral surface 57 arranged on the orifice member 50 is the outer circular peripheral surface. Instead of the above described configuration, a cylindrical portion can be formed at the end portion of the orifice member 50, and then an inner circular peripheral surface is arranged at an inside of the cylindrical portion. In the above described modification example, the positioning member is provided in an inside of the inner circular peripheral surface to be fixed to the inner circular peripheral surface.

Additional advantages and modifications will readily occur to those skilled in the art. The invention in its broader terms is therefore not limited to the specific details, representative apparatus, and illustrative examples shown and described.

What is claimed is:

1. A fuel injection device comprising:

a valve body having therein a passage for a high-pressure fuel, the valve body being provided with injection holes that are arranged at a tip end of the valve body to inject the high-pressure fuel to an inside of a combustion chamber of an internal combustion engine;

a valve member that moves in an axial direction of the valve body therein to allow or interrupt a supply of the high-pressure fuel to the injection holes;

a housing member that is structured to face an end of the valve body and to define a pressure chamber, which controls movement of the valve body by adjusting fuel pressure applied to the valve body, and forms control passages through which fuel flows for controlling the fuel pressure in the pressure chamber; and a positioning member that is annular-shaped and is fixed to an outer circular peripheral surface of the valve body and fixed to an outer circular peripheral surface of the housing member, to set locations of the valve body and the housing member in a radial direction and to cover the valve body and the housing member;

a fixing member provided radially outside of the positioning member to fix the valve body and the housing member in the axial direction;

a holder threaded with the fixing member, a cylinder holding a piston portion arranged at an end portion of the valve member, the cylinder being located to be urged toward the housing member, and the cylinder defining the pressure chamber together with the housing member, and a control member that is provided in an inside of the pressure chamber and contacts and detaches from the housing member to at least allow or interrupt a communication between an inflow passage and an outflow passage, wherein the valve body and the housing member are pressed toward the holder when the fixing member is fitted to the holder, the positioning member is not in contact with the fixing member;

a radial location of the cylinder is set by the valve member, a radial location of the valve member is set by the valve body, the control passages include the inflow passage, which introduces fuel to the pressure chamber, and the outflow passage, which discharges the fuel out of the pressure chamber, a radial location of the control member is defined by the valve body and the cylinder, the housing member and the control member contact at a flat sealing surface that allows or interrupts a communication between the inflow passage and the pressure chamber, the positioning member extends in the axial direction of the fixing member across both a sealing surface of the housing member and a sealing surface of the valve body, wherein the sealing surface of the housing member faces the sealing surface of the valve body in the axial direction, and the sealing surface of the housing member and the sealing surface of the valve body are partially in contact with each other in the axial direction;

wherein the positioning member allows rotation of the valve body relative to the housing member.

2. The fuel injection device according to claim 1, wherein at least one of the valve body and the housing member has a stepped surface that sets a location of the positioning member in the axial direction.

3. The fuel injection device according to claim 2, wherein an axial length of the positioning member is larger than an axial length of the circular peripheral surface of the housing member that is adjacent to the stepped surface.

4. The fuel injection device according to claim 3, further comprising:

a return spring provided between the housing member and the valve member to urge the valve member to a valve-close direction, wherein an axial length of the circular peripheral surface of the housing member and an axial length of the positioning member are set such that a length (GP) of a projection of the positioning member projecting in the axial direction from the circular peripheral surface of the housing member is larger than a compression amount (SP) of the return spring, such that GP>SP.

5. The fuel injection device according to claim 2, wherein a thickness (GW) of the positioning member is less than a width (RW) of a stepped portion, such that GW<RW.

6. The fuel injection device according to claim 1, wherein the positioning member has a slope that guides at least one of the valve body and the housing member to a fixing location.

7. The fuel injection device according to claim 1, wherein the control passage includes a common supply passage that is commonly used for introducing the fuel into the pressure chamber and discharging the fuel out of the pressure chamber.

8. The fuel injection device according to claim 1, wherein the fixing member is provided radially outside of the valve body and the housing member to cover at least a portion of both the valve body and the housing member.

9. The fuel injection device according to claim 1, wherein a width of the positioning member becomes smaller toward at least one axial end thereof.

10. The fuel injection device according to claim 1, wherein the positioning member has two enlarged inner portions at both ends thereof.

11. The fuel injection device according to claim 1, wherein the positioning member is disposed to contact a stepped surface of the housing member so that the stepped surface limits movement of the positioning member and sets an axial position of the positioning member.

12. The fuel injection device according to claim 1, wherein the piston portion is arranged within the cylinder to be slidably supported by an inner wall of the cylinder.

13. The fuel injection device according to claim 1, wherein the inflow passage communicates with an inflow port that is opened to an abutting surface of the housing member, the outflow passage communicates with an outflow port opened to the abutting surface of the housing member, the abutting surface of the housing member and the sealing surface of the housing member are on the same surface, and the abutting surface of the housing member is located at a radially inner side of the sealing surface of the housing member.

14. The fuel injection device according to claim 1, wherein the pressure chamber is defined by the cylinder, the housing member and the valve member.

15. The fuel injection device according to claim 1, wherein the control member is configured to simultaneously seal the inflow passage and provide a throttle portion in fluid communication with the outflow passage.

* * * * *